United States Patent [19]

Petkov et al.

[11] Patent Number: 5,029,415

[45] Date of Patent: Jul. 9, 1991

[54] APPARATUS FOR CENTRIFUGAL HYDROMECHANICAL CLEANING AND POLISHING

[75] Inventors: Georgi K. Petkov; Bentsho P. Kyurktshiev, both of Gabrovo; Stamennedeltshev Stoev, Sevlievo; Georgi I. Ivanov; Stefan P. Mintshev, both of Gabrovo, all of Bulgaria

[73] Assignee: T I P O M, Gabrovo, Bulgaria

[21] Appl. No.: 504,975

[22] Filed: Apr. 5, 1990

[51] Int. Cl.[5] ..... B24B 31/00

[52] U.S. Cl. ..... 51/17; 51/7; 51/164.1; 134/153

[58] Field of Search ..... 51/17, 22, 7, 144.1, 51/163.1, 313; 134/153, 157

[56] References Cited

U.S. PATENT DOCUMENTS

| | | | |
|---|---|---|---|
| 3,855,441 | 12/1974 | Kimmelmann | 51/7 X |
| 4,258,505 | 3/1981 | Scheiber et al. | 51/7 |
| 4,660,326 | 4/1987 | Petkov et al. . | |
| 4,773,244 | 9/1988 | Honda et al. | 51/7 X |

FOREIGN PATENT DOCUMENTS

| | | |
|---|---|---|
| 41700 | 8/1987 | Bulgaria . |
| 641505 | 1/1979 | U.S.S.R. . |

*Primary Examiner*—D. S Meislin

*Attorney, Agent, or Firm*—Klein & Vibber

[57] ABSTRACT

An apparatus for centrifugal hydromechanical cleaning and polishing has a working cylinder filled with a working medium which is a mixture of working bodies and working fluid. The cylinder is closed by a left and a right cover. The covers are provided with sleeves through which a billet to be cleaned can pass. In the axis of the cylinder there is fixed a perforated pipe which is connected to a feed pump. The left cover is provided with a hole for charging the cylinder with a working medium, which is hermetically closed with a cap. The working cylinder is seated on supporting rolls and is rotated on its axis. In an alternative embodiment of the apparatus, bearing units are pressed-in eccentrically in both covers and billets are positioned in the bearing units and rotated by a transmission mechanism. In both embodiments, as the cylinder rotates, centrifugal forces cause the working bodies to envelop the billets and abrade them. Products of abrasion washed away by circulating working fluid.

6 Claims, 2 Drawing Sheets

APPARATUS FOR CENTRIFUGAL HYDROMECHANICAL CLEANING AND POLISHING

FIELD OF THE INVENTION

The invention relates to an apparatus for centrifugal hydromechanical cleaning and polishing which can be used in general engineering and metallurgy for the cleaning of wires or billets of limited or unlimited length.

BACKGROUND OF THE INVENTION

A known apparatus for cleaning billets of unlimited length is disclosed in USSR Inventor's Certificate No. 641505. This apparatus comprises a movable housing, which is positioned vertically and is connected with a drive mechanism. In the bottom of the movable housing there is provided a hole and in its top there is mounted a membrane which is connected with a mechanism for reciprocating motion. The latter is realized as a cam which is in touch with the membrane. The cam is connected with a centrifugal mechanism which is attached to the movable housing. Inside the movable housing there is formed a chamber filled with a working medium.

A drawback of this apparatus is that only the working medium around the billet to be cleaned takes part in the process of cleaning and, since there are not provided means for its continuous restoration, it is quickly saturated with oxides detached from the billet and its cleaning properties are impaired. Another drawback of this known apparatus is that, in order to restore its cleaning properties, it is necessary to stop the apparatus and to replace the working medium and this results in a reduction of the capacity of the process.

Another known apparatus for hydromechanical cleaning and polishing billets of unlimited length is disclosed in Bulgarian Inventor's Certificate No. 41700. This known apparatus comprises a movable housing connected with a drive mechanism. Inside the housing there is formed a chamber filled with a working medium. The movable housing is provided with a membrane connected with a mechanism for reciprocating motion mounted on a sliding joint in the chamber of the movable housing. The working medium is a mixture of balls and working fluid, and the movable housing is connected with a source for the working fluid.

A drawback of this apparatus is that the billet to be cleaned is disposed in the center of the chamber, where the peripheral velocity of the working bodies is the lowest and this results in a low capacity of the process. Another drawback is that, for the continuous restoration of the working surfaces of the balls, a complex kinematic scheme is necessary which effects a rotational and reciprocal motion, synchronized in sequence for different chambers, and this results in a reduction of the reliability of the apparatus.

SUMMARY OF THE INVENTION

It is, therefore, a general object of the invention to develop an apparatus for centrifugal hydromechanical cleaning and polishing which increases the capacity of the process by several times, by ensuring a sufficient contact pressure between the worked surface of the billet and the working medium with a continuous self-restoration of the working surface of said medium. This results in an improvement of the worked surface of the billet, and versatility and reliability of the apparatus.

This object is achieved by an apparatus which comprises a working cylinder filled with a working medium comprising a mixture of working bodies (e.g. balls) and fluid. The cylinder is closed by a left and a right cover. In the axis of the cylinder, there is fixed a perforated pipe which is connected to a pump which recirculates working fluid. One of the covers is provided with a hole for charging, which is hermetically closed. The working cylinder is seated on supporting rolls and is provided with outlet holes for discharging working fluid.

In an alternative embodiment of the apparatus there are pressed-in eccentrically in both covers bearing units in which there are positioned the worked billets, driven by a transmission mechanism.

An advantage of the apparatus in accordance with the invention is that, due to the centrifugal force produced as a result of the rotational motion of the working cylinder, the working medium is constantly self-restored and the fluid is regenerated, thus ensuring constant cleaning and polishing properties. Another advantage is that it is possible to clean simultaneously several billets, thus increasing several times the capacity of the process. Another advantage is that there the circulation of the working fluid is effected in a natural way, thus effecting an intensive cooling in the contact zone of working, a washing of the working bodies, and a carrying away of the oxides detached from the billets.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
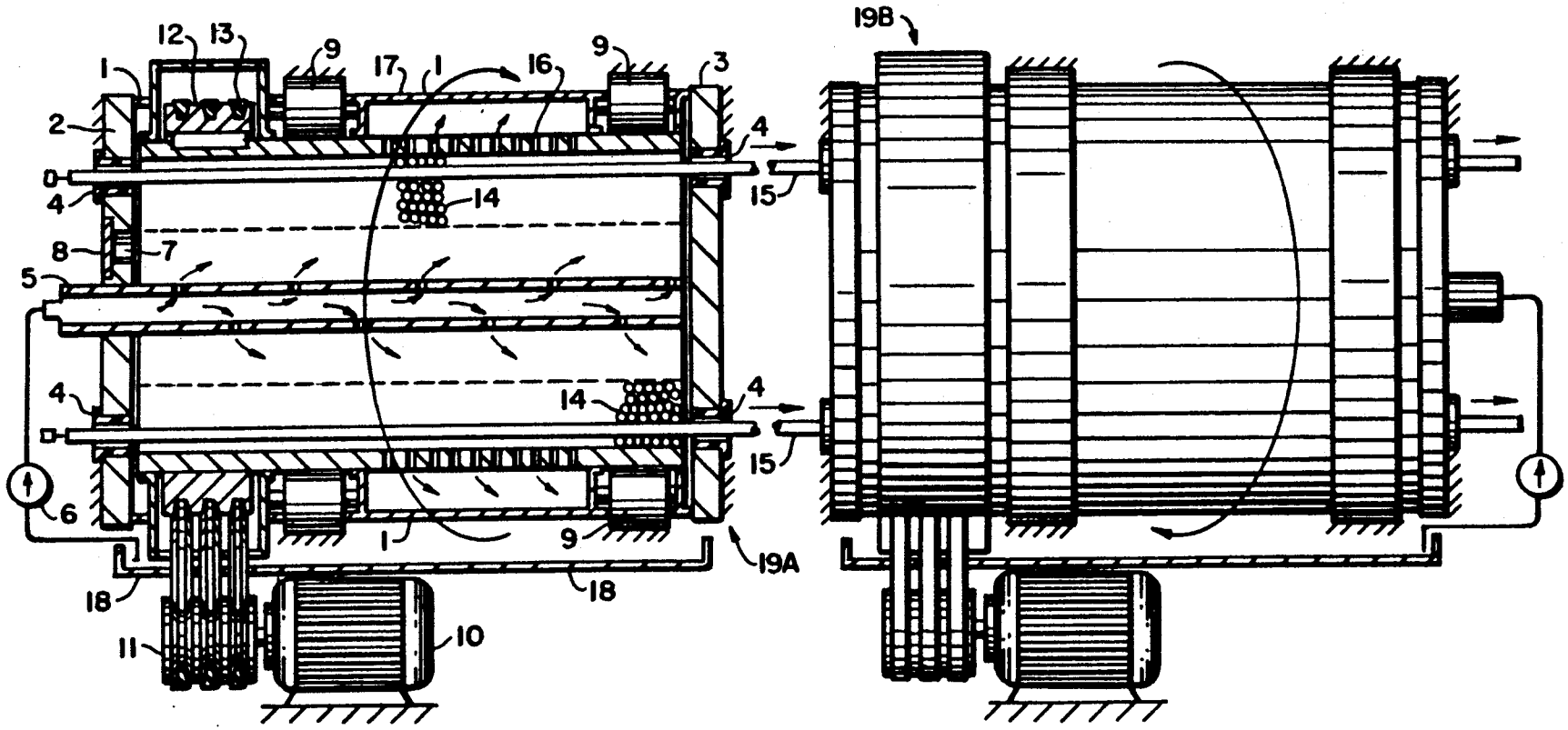
FIG. 1 is a schematic longitudinal sectional view of an apparatus according to the invention.
Figure 2:
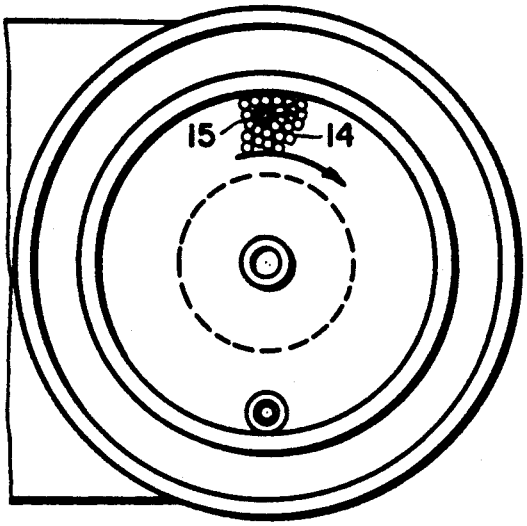
FIG. 2 is a schematic illustration of the contact between the worked billet and the working medium.

Referring now to FIGS. 1 and 2, one embodiment of the inventive apparatus comprises a movable working cylinder 1, to which there are rotationally fastened a left cover 2 and a right cover 3, in which there are pressed-in quickly replaceable guiding sleeves 4. In the axis of the left cover 2 and the right cover 3 there is fixed rigidly a perforated pipe 5, connected to a feed pump 6. In the left cover 2 there is machined a hole 7 for charging the apparatus with working medium. The hole 7 is advantageously closed hermetically by the cap 8.

The movable working cylinder 1 is seated on two rows of supporting rolls 9 and is driven by an electric motor 10 by means of a belt transmission, consisting of belt pulleys 11 and 12, which are connected by belt 13.

Inside the working cylinder 1, the working bodies 14 are poured-in, and one or several worked billets 15 pass through them along the cylinder axis as shown in FIGS. 1 and 2.

In several parts of the movable working cylinder 1, there are drilled outlet holes 16. The whole device is enclose inside a protective hood 17, in the bottom of which there is provided a collecting pin 18. In line with the aforedescribed apparatus 19A, there is preferably disposed a duplicate apparatus 19B.

Figure 3:
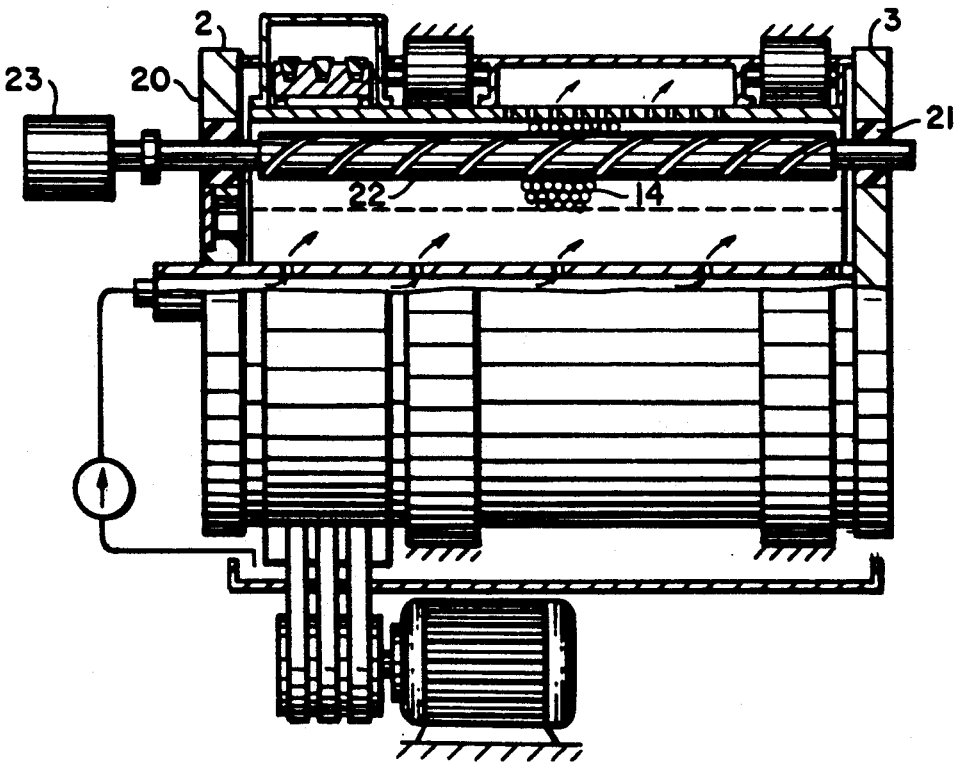
FIG. 3 is a schematic longitudinal sectional view similar to FIG. 1, but of another embodiment of the apparatus.

FIG. 3 shows an alternative embodiment, which can be used for the working of rotational billets of limited length. In the left cover 2 and the right cover 3 there provided supporting bearing units 20 and 21 in which the worked billet 22 is fixed, being variably and reversibly driven around its axis by means of a transmission mechanism 23.

Method of Operation (first embodiment)

Referring again to FIGS. 1 and 2, the billets 15 are passed through the guiding sleeves 4 of the left cover 2 and the right cover 3 of the centrifugal hydromechanical apparatus 19A. Through the hole 7, there is charged a preset quantity of working bodies 14 and hole 17 is then closed hermetically with the cap 8.

The feed pump 6 is switched-on, which is connected to the spraying perforated pipe 5, thus ensuring the feeding and spraying of working fluid from the center toward the periphery of the working cylinder 1.

By means of the electric motor 10, the belt 13 and the belt pulley 12, a rotational motion is transmitted to the working cylinder 1. As a result of the produced centrifugal forces, the working bodies 14 form an elastic ring around the billets 15 as shown in detail in FIG. 2.

The working fluid continuously washes the working bodies 14 and carries away the detached metal oxides and abrasive particles which are removed from billets 15. To achieve a better cleaning of the billets 15, they are passed immediately after the outlet from apparatus 19A through the next-following duplicate apparatus 19B, the working cylinder 1 of which preferably rotates in a direction opposite to that of the aforedescribed first centrifugal hydromechanical apparatus 19A.

Method of Operation (second embodiment)

Referring once again to FIG. 3, a billet 22 is positioned in the bearing seats 20 and 21 and then the working cylinder 1 is driven as described in the first embodiment with reference to FIG. 1.

An elastic ring of working bodies 14 constantly envelopes the worked billet 22, the latter being driven by a transmission mechanism 23 in one or another direction variable until the termination of the working billet 22.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Apparatus for centrifugal hydromechanical cleaning and polishing of billets comprising a rotatable working cylinder and a first drive means for rotating said cylinder;

said cylinder being closed by a cover at each end in a manner whereby said cylinder is rotatable with respect to said covers;

said covers being provided with means whereby a billet enters said cylinder through one cover and exits said cylinder through the other cover;

a working medium comprising a mixture of working bodies and working fluid, said working bodies being contained inside said working cylinder;

a perforated pipe located within said cylinder and extending axially through said cylinder from one end to the other;

said pipe being connected through one of said covers to a feed pump;

said cylinder being provided with outlet means through which working fluid may freely pass;

a collecting means arranged in proximity to said outlet means to collect working fluid passing through said outlet means;

said feed pump being connected to said collecting means whereby said working fluid is recycled from said collecting means to said perforated pipe and into said cylinder.

2. An apparatus as claimed in claim 1, further comprising bearing means in each of said covers whereby a billet is mounted in said bearing means; and second drive means operatively connected to said billet to rotate said billet in said bearing means.

3. An apparatus as claimed in claim 1, further comprising said pipe being fixed to said covers.

4. An apparatus as claimed in claim 1, further comprising one of said covers being provided with an hermetically sealable opening for filling said working bodies into said cylinder.

5. An apparatus as claimed in claim 1, further comprising supporting roller means upon which said cylinder rotatably rests.

6. An apparatus as claimed in claim 1, further comprising a protective hood, said collecting means being located at the bottom of said protective hood.

* * * * *